United States Patent [19]

Campbell

[11] 4,334,683

[45] Jun. 15, 1982

[54] DISC GAME APPARATUS

[76] Inventor: James B. Campbell, P.O. Box 6, Malvern, Pa. 19355

[21] Appl. No.: 173,480

[22] Filed: Jul. 30, 1980

[51] Int. Cl.[3] ..... A63F 3/00

[52] U.S. Cl. ..... 273/126 R; 229/22; 46/26; 273/128 R

[58] Field of Search ..... 273/126 R, 31, 85 R, 273/108, 118 R, 119 R, 1 R, 127 R, 128 R; 272/3; 46/1 L, 26, 31; 229/22, 8, 41

[56] References Cited

U.S. PATENT DOCUMENTS

| | | | |
|---|---|---|---|
| 687,968 | 12/1901 | Reber | 229/22 |
| 1,653,914 | 12/1927 | Keppler | 229/22 |
| 2,238,703 | 3/1941 | McIver et al. | 273/126 R |
| 2,727,744 | 12/1955 | Watson | 273/128 R |
| 2,877,506 | 3/1959 | Alonoslino | 46/26 |
| 3,000,134 | 9/1961 | Marini | 46/26 |
| 3,033,570 | 5/1962 | Mathes et al. | 273/126 R |
| 3,042,407 | 7/1962 | Gorgol | 273/126 R |
| 3,178,092 | 4/1965 | Munana et al. | 229/22 |
| 3,206,208 | 9/1965 | Bates | 273/128 R |
| 3,653,666 | 4/1972 | Barlow | 273/126 R |
| 4,000,900 | 1/1977 | Lehmann | 273/126 R |
| 4,182,072 | 1/1980 | Much | 46/26 |

FOREIGN PATENT DOCUMENTS

| | | | |
|---|---|---|---|
| 2506181 | 8/1976 | Fed. Rep. of Germany | 273/128 CS |
| 170482 | 1/1935 | Switzerland | 273/85 R |
| 2240 | of 1898 | United Kingdom | 273/127 R |
| 187591 | 4/1922 | United Kingdom | 46/26 |

*Primary Examiner*—Richard C. Pinkham
*Assistant Examiner*—T. Brown
*Attorney, Agent, or Firm*—Charles A. McClure

[57] ABSTRACT

Game apparatus for use on a tabletop or other flat surface has modular structural pieces for forming an open-ended stadium and pucks to be propelled thereinto. The structural pieces are prismoidal, preferably folded into suitable shape from paper blanks suitably scored for folding, and provided with means for securing them end-to-end. The pucks are generally disc-shaped and provided with protrusions or "feet" to support them during propulsion along the flat surface.

5 Claims, 10 Drawing Figures

DISC GAME APPARATUS

This application is in part a substitute for my abandoned application, Ser. No. 261,380 filed in 1972.

This application relates to tabletop game apparatus conducive to simulating, on a greatly reduced scale, some of the features of curling or of modified lawn bowling. An open-ended miniature stadium structure functions to contain playing pieces or pucks on a tabletop or other flat playing surface along which the pucks are propelled.

A primary object of the present invention is modular formation of an open-ended miniature stadium structure adapted to receive and generally retain pucks propelled thereinto.

Another object of this invention is provision of such a stadium structure having a plurality of vertical faces angled relative to one another and adapted to cause pucks propelled thereagainst to ricochet therefrom.

A further object of this invention is provision of playing pieces or pucks adapted to slide along a flat surface and to ricochet from such flat vertical surfaces of such open-ended stadium-like structure and to be retained generally within the open end thereof with or without ricochetting from contact with the vertical walls thereof.

Other objects of the present invention, together with means and methods of attaining the various objects, will be apparent from the appended drawings and following description of an embodiment of the invention, presented by way of example rather than limitation.

In general, the objects of this invention are accomplished, in game apparatus having an open-ended stadium structure for mounting on a flat playing surface and a plurality of pucks for propelling along such a flat playing surface into the open end of the stadium structure. More particularly, the stadium structure comprises a plurality of like prismoidal structural pieces juxtaposed end-to-end and a plurality of clips, each clip adapted to securing two prismoidal pieces juxtaposed end-to-end, together with a suitable number of pucks, preferably including a target puck of dissimilar size.

Figure 1:
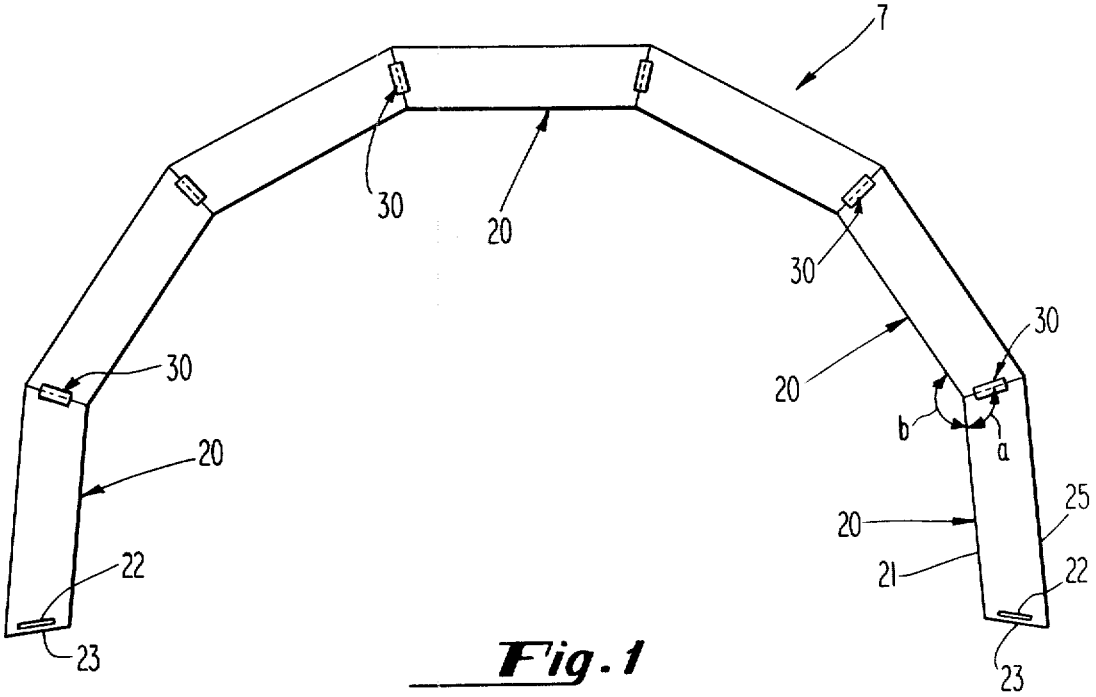
FIG. 1 is a plan view of an open-ended stadium-like structure useful according to this invention.

FIG. 1 shows, in plan, generally semicircular open-ended stadium structure 7 formed of seven prismoidal structural pieces 20, trapezoidal in plan, placed end-to-end to form essentially one-half of a would be polygonal ring. The end angle of the prismoidal pieces is such that the open end of the stadium structure flares outward slightly, circumscribing a total angle somewhat less than a half circle. See subsequent views and their descriptions for identification of other features of this view.

Figure 2:
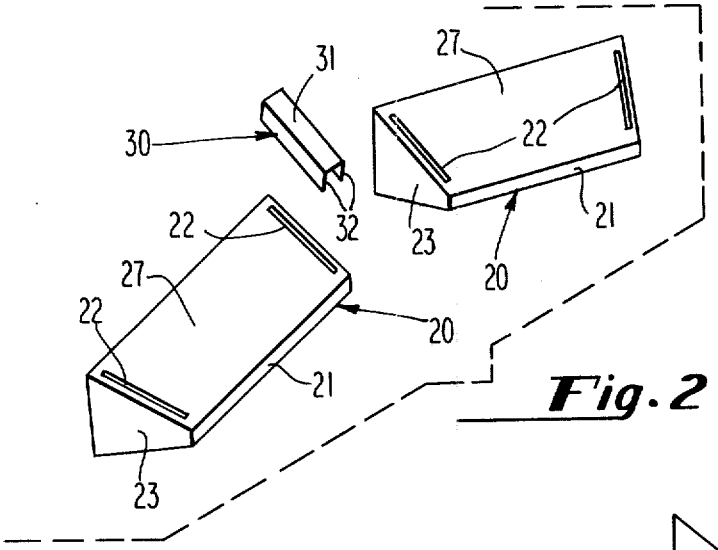
FIG. 2 is a perspective view of a pair of modular prismoidal structural pieces suited to making up part of the stadium structure of FIG. 1, together with a clip for retaining them together end-to-end.

FIG. 2 shows, in perspective, two such prismoidal structural pieces 20, each having a generally short vertical front or inwardly oriented wall face 21, a plurality of angled end faces 23 (one each visible) and a tall vertical rear wall face 25 (see FIG. 3) joined above by a sloping top surface 27 and underneath (FIG. 3) by a horizontal bottom surface 29. The sloping top face has pair of slots 22 individually paralleling the respective end faces and spaced narrowly therefrom. Clip 30 has a U-shaped transverse cross-section and is shown in the form of an inverted channel, with its flanges 32 extending downward from web 31 in position to engage slots 22 in the top surfaces of adjacent prismoidal pieces when juxtaposed end-to-end as in FIG. 1.

Figure 3:
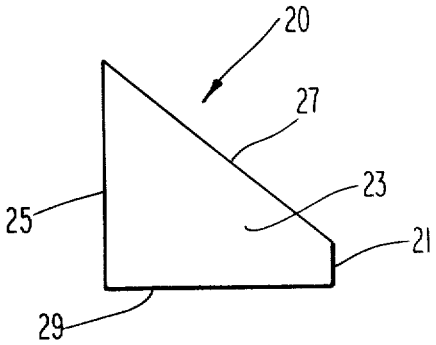
FIG. 3 is an end elevation of one such prismoidal structural piece on an enlarged scale.

FIG. 3 shows such a prismoidal piece in end elevation with its various surfaces identified as noted above in description of FIG. 2.

Figure 4:
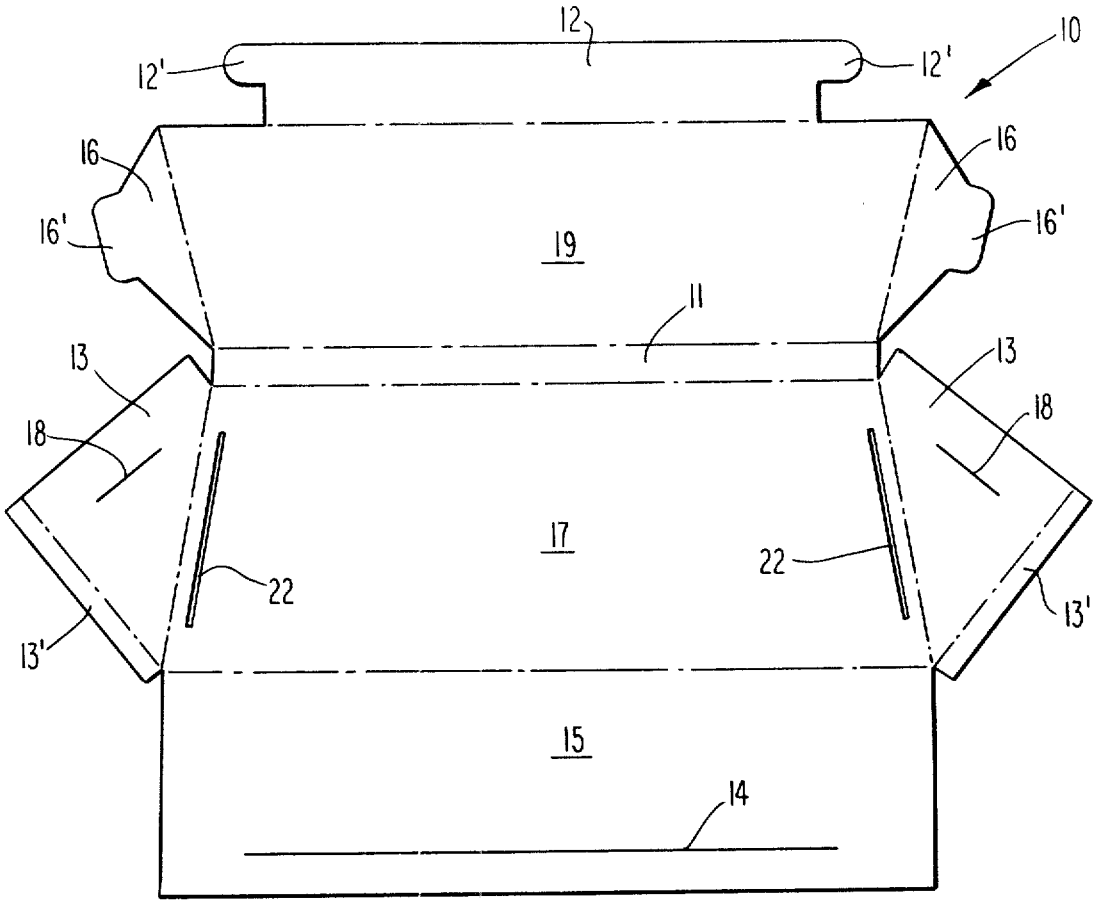
FIG. 4 is a plan view of a blank of sheet material foldable into a prismoidal structural piece of FIGS. 2 and 3.

FIG. 4 shows, in plan, blank 10 die-cut and scored (indicated by broken lines) for folding into any one of prismoidal pieces 20. The blank comprises a plurality of longitudinally extending (widthwise of the view) panels parallelling one another along intervening fold lines (shown dot-dashed). Centralmost panel 11 adapted to form front wall face 21 of preceding views is flanked by panel 19 adapted to form bottom surface 29 and by broad panel 17 adapted to form sloping top surface 27. The bottom surface panel has adjoining tuck flap panel 12 with pair of end tabs 12', and the top surface panel has adjoining rectangular panel 15 adapted to form rear wall face 25 and having longitudinal slit 14 therein close to its free edge to receive the tuck flap as shown subsequently. Bottom surface panel 19 has a trapezoidal outline flaring out toward the tuck flap and having opposite end flaps 16, each with tuck end tab 16', adjoining along fold lines. Top surface panel 17 is also trapezoidal in outline, flaring oppositely to panel 19, and having at opposite ends flaps 13 of generally triangular outline adjoining it along fold lines. Each such end flap has auxiliary strip 13' along the edge nearer rear wall face panel 15 and has slit 18 paralleling the other free edge of the flap to receive one of end tabs 16' on the bottom surface panel tuck flap.

Figure 5:
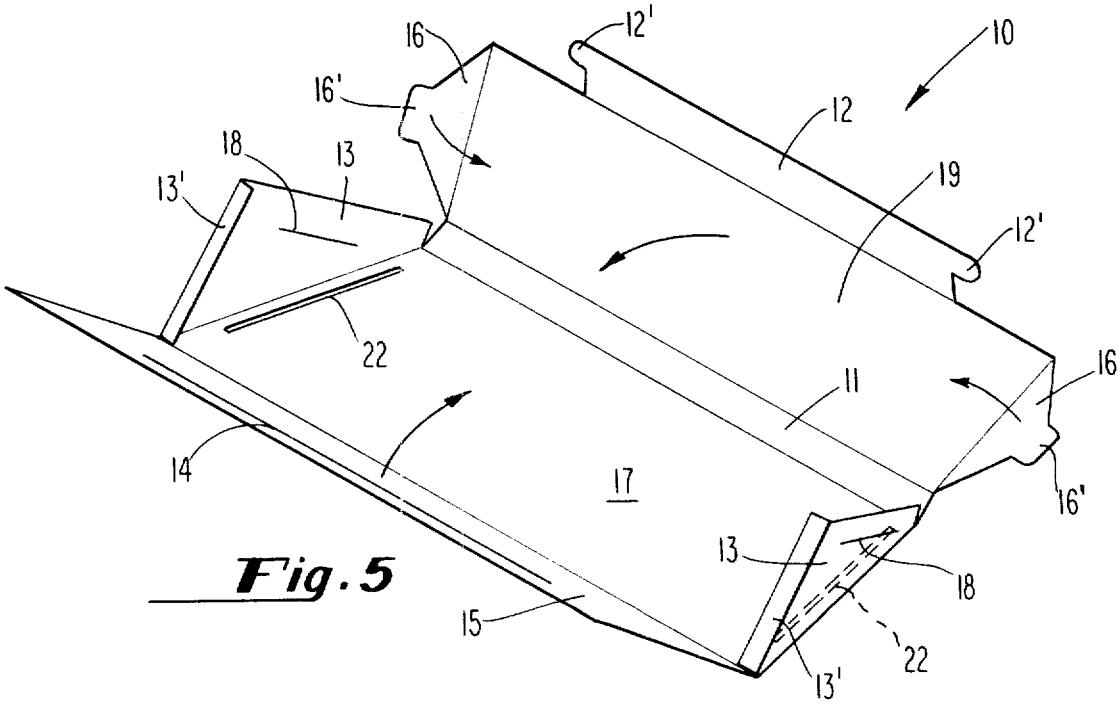
FIG. 5 shows, in perspective, the blank of FIG. 4 at a stage in folding into prismoidal form.
Figure 6:
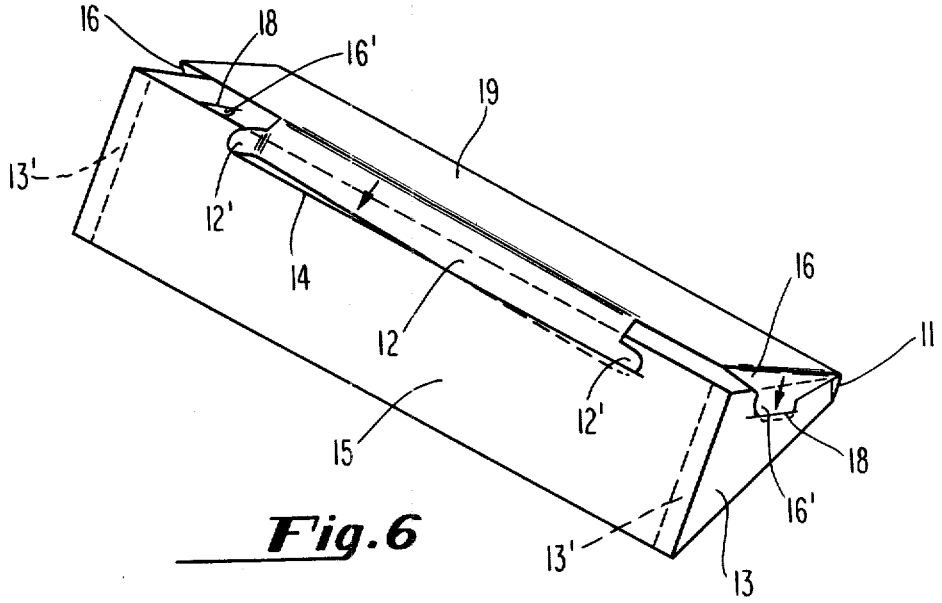
FIG. 6 shows the same blank at a later stage in folding into prismoidal form.

FIGS. 5 and 6 show, in perspective, successive stages in the folding of blank 10 into prismoidal shape to form such prismoidal structural piece 20. Of course, the orientation shown in these views is not the usage orientation shown in FIGS. 1–3 but has as its purpose demonstration of the folding or assembly procedure. At an early stage in the folding, shown in FIG. 5, pair of generally triangular flaps 13 (each with tab 13') are folded perpendicular to sloping top surface panel 17 (and strips 13' folded perpendicular to their respective flaps). The blank is folded along all its parallel fold lines so as to begin to form with the visible faces of the respective panels the inside of the eventual prismoidal structure.

FIG. 6 shows a nearly final stage in the folding wherein pair of slits 18 receive the respective tabs 16' on flaps 16 folded perpendicular to supporting bottom panel 19, and end tabs 12' of tuck flap panel 12 are being inserted together with the flap into slit 14 of rear wall panel 15. Narrow front wall panel 11 is folded perpendicular to the bottom panel, of course. Fully folded, with the tuck flap and various tabs inserted into the appropriate slots, blank 10 assumes the form of a prismoidal structural piece 20, as just demonstrated and readily appreciated by observation of the pertinent drawings and description.

Figure 7:
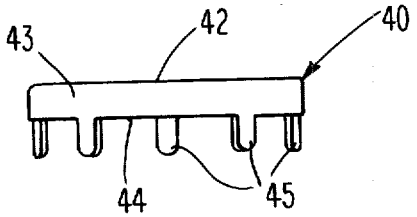
FIG. 7 is a side elevation of a playing piece or puck useful according to this invention.
Figure 8:
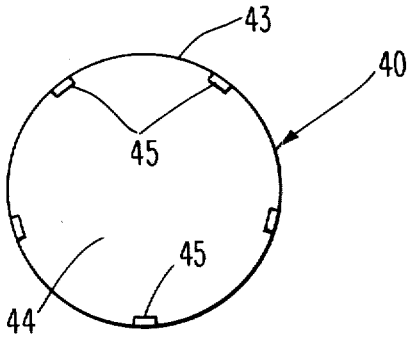
FIG. 8 is a bottom plan of the puck of FIG. 7.

FIG. 7 shows in elevation, and FIG. 8 in bottom plan, playing piece or puck 40 in the form of a shallow cylinder or disc with flat top surface 42 and five protrusions or "feet" 45 from flat bottom surface 44 spaced equidistant apart near cylindrical outer edge 43.

Figure 9:
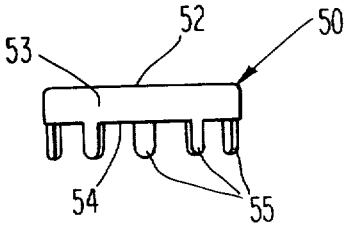
FIG. 9 is a side elevation similar to FIG. 7 but of a puck of a different size.
Figure 10:
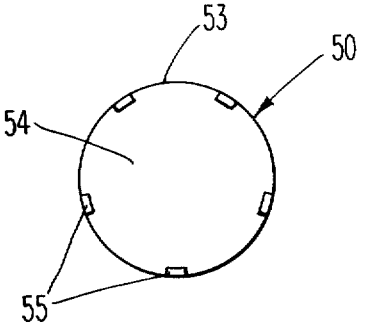
FIG. 10 is a bottom plan view similar to FIG. 8 but of the puck of FIG. 9.

FIGS. 9 and 10 show a similar puck 50 of different size having top surface 52, cylindrical surface 53, bottom surface 54, and feet 55.

Assembled as shown in FIG. 1 to form an open-ended stadium structure, seven prismoidal structural pieces 20 are retained end-to-end in generally semicircular plan by a half dozen clips 30. The interior angle, a, formed between the end face and front face of each prismoidal piece exceeding a right angle, the respective front faces intersect one another to form an exterior angle, by less than a straight angle. The stadium structure circumscribes an arc less than a half circle by at most about twenty-five degrees.

In use, pucks 40 and 50 are propelled into the open end of stadium structure 7, with or without contact with vertical front walls 21 of the assembled component prismoidal structural pieces and/or one another. For example, smaller puck 50 may be propelled first (or even set in place) to act as a target for succeeding pucks, which may be differently colored or otherwise differentiated for identification with respective players. After all the pucks have been so propelled scoring may be based on propinquity to the target puck with or without other scoring features. Propulsion of the pucks may be directly manual, as by flicking by a forefinger, or indirectly by means of a hand-held stick. The slight flare of the open end of the stadium and the straight front faces of the various prismoidal pieces make additional demands upon the skills of the players and lend interest to the game. Seven such faces are preferred; substitution of another number from five to nine, preferably odd, could be made if desired.

Any suitably foldable sheet material such as tag paper, can be used for the blanks to form the prismoidal structural pieces, as is preferred. Alternatively, a formed prismoidal solid, such as a plastic molding, may be substituted for the folded structural piece. The pucks may be molded from plastic material, such as polyvinyl chloride or nylon, for example, or could be made of wood or compressed sawdust, etc. The clips or similarly suitable retaining means may be made of such plastic or of metal, as may be convenient. Selection of suitable materials for the components of the game apparatus of this invention is well within ordinary skill.

Although a preferred embodiment of the present invention has been shown and described, one or more modifications have been suggested above. Other modifications may be made, as by addition, combination, or division of parts, while retaining at least some of the advantages or benefits of the invention, which is defined only in the following claims.

The claimed invention is:

1. In game apparatus having an open-ended stadium structure generally semicircular in plan for mounting on a flat playing surface and a plurality of pucks for propelling along such a flat playing surface into the open end of the stadium structure, the improvement comprising a modular stadium structure assembled from a plurality of structural pieces disengageably secured end-to-end, each such structural piece having a generally vertical front face intersecting the flat playing surface and facing inward of the assembled stadium, the exterior angle so formed between adjacent front faces being less than a straight angle by less than thirty degrees but more than half that much, the assembled stadium structure circumscribing an arc less than a half circle by at most about twenty-five degrees.

2. Game apparatus according to claim 1, comprising a plurality of clips, each clip adapted to securing two such structural pieces disengageably end-to-end.

3. Game apparatus according to claim 1, the assembled stadium structure, comprising seven such pieces.

4. Game apparatus according to claim 1, wherein each puck comprises a disc supported on feet spaced equidistant along the peripheral edge of the under side of the disc.

5. Game apparatus according to claim 4, wherein each puck has 5 feet.

* * * * *